United States Patent [19]

Yamamoto et al.

[11] Patent Number: 4,803,088

[45] Date of Patent: Feb. 7, 1989

[54] CONTAINER PACKED WITH INSTANT FOOD FOR USE IN MICROWAVE OVEN

[75] Inventors: Masanori Yamamoto, Kaizuka; Tamotsu Kamoda, Kishiwada; Makoto Nakahara, Higashiosaka; Yoshimasa Fujii, Yamato-Kouriyama; Shozo Sugano, Nara, all of Japan

[73] Assignee: House Food Industrial Company Limited, Higashiosaka, Japan

[21] Appl. No.: 855,673

[22] Filed: Apr. 25, 1986

[30] Foreign Application Priority Data

| | | | |
|---|---|---|---|
| May 1, 1985 | [JP] | Japan | 60-94385 |
| Aug. 7, 1985 | [JP] | Japan | 60-121415[U] |
| Sep. 18, 1985 | [JP] | Japan | 60-143177[U] |

[51] Int. Cl.[4] ..... B65D 81/34

[52] U.S. Cl. ..... 426/107; 426/87; 426/113; 426/118; 426/120; 426/124; 426/557; 426/564; 426/589; 426/115; 426/234; 426/509

[58] Field of Search ..... 426/107, 113, 234, 243, 426/86, 112, 412, 241, 87, 508, 509, 118, 115, 451, 557, 120, 124

[56] References Cited

U.S. PATENT DOCUMENTS

| | | | |
|---|---|---|---|
| 2,899,318 | 8/1959 | Long | 426/120 |
| 3,144,931 | 8/1964 | Long | 426/112 |
| 3,156,352 | 11/1964 | Hayhurst | 426/120 |
| 3,228,776 | 1/1966 | Savage et al. | 426/114 |
| 3,293,048 | 12/1966 | Kitterman | 426/113 |
| 3,539,359 | 11/1970 | Murchison | 426/113 |
| 3,542,190 | 11/1970 | Keller | 426/115 |
| 3,563,768 | 2/1971 | Melnick | 426/120 |
| 3,598,609 | 8/1971 | Hoynak | 426/115 |
| 3,928,045 | 12/1975 | Tsunoda et al. | 426/113 |
| 3,976,795 | 8/1976 | Ando | 426/124 |
| 3,997,676 | 12/1976 | Ando | 426/113 |
| 4,018,355 | 4/1977 | Ando | 426/120 |
| 4,018,904 | 4/1977 | Muraoka | 426/115 |
| 4,051,879 | 10/1977 | Itagaki | 426/113 |
| 4,094,996 | 6/1978 | Sakakibara et al. | 426/115 |
| 4,137,333 | 1/1979 | Daswick . | |
| 4,166,139 | 8/1979 | Ishida | 426/115 |
| 4,185,125 | 1/1980 | Sakakibara et al. | 426/451 |
| 4,230,735 | 10/1980 | Yoshida et al. | 426/113 |
| 4,233,325 | 11/1980 | Slangan et al. | 426/113 |
| 4,348,421 | 9/1982 | Sakakibara et al. | 426/115 |
| 4,416,906 | 11/1983 | Watkins | 426/107 |
| 4,574,174 | 3/1986 | McGonigle . | |
| 4,596,713 | 6/1986 | Burdette | 426/113 |
| 4,642,434 | 2/1987 | Cox | 426/243 |

FOREIGN PATENT DOCUMENTS

| | | | |
|---|---|---|---|
| 704569 | 3/1965 | Canada | 426/112 |
| 969139 | 6/1975 | Canada | 426/114 |
| 1098342 | 10/1957 | Fed. Rep. of Germany | 426/120 |
| 2230698 | 1/1974 | Fed. Rep. of Germany | 426/557 |
| 2643225 | 3/1978 | Fed. Rep. of Germany | 426/115 |
| 39945 | 10/1962 | Japan | 426/115 |
| 482778 | 1/1973 | Japan | 426/412 |
| 57-12228 | 1/1982 | Japan | 426/234 |
| 604567 | 9/1978 | Switzerland | 426/412 |
| 2007489 | 5/1979 | United Kingdom | 426/114 |

*Primary Examiner*—Steven Weinstein
*Attorney, Agent, or Firm*—Oblon, Fisher, Spivak, McClelland & Maier

[57] ABSTRACT

The present invention relates to a container packed with instant food to be cooked by a microwave oven which allows a solid instant food such as instant chow mein and instant macaroni to be reconstituted to its original cooked state with good texture in a short period of time when the food is cooked in a microwave oven without the need to drain water after it is cooked.

The container packed with instant food comprises: a container composed of a container body and a lid which is capable of tightly or substantially tightly sealing said container; and a solid instant food accommodated in said container, wherein said food is to be reconstituted and made ready for eating on absorbing water when said container packed with said food is heated in a microwave oven after water is added thereto in an amount equivalent to between 100 and 155 wt % of the water absorption capacity of said food.

1 Claim, 1 Drawing Sheet

CONTAINER PACKED WITH INSTANT FOOD FOR USE IN MICROWAVE OVEN

BACKGROUND OF THE INVENTION (1) Field of the Invention

The present invention relates to a container packed with instant food to be cooked by a microwave oven which allows a solid instant food such as instant chow mein and instant macaroni to be reconstituted to its original cooked state with good texture in a short period of time when the food is cooked in a microwave oven without the need to drain hot water after it is cooked.

(2) Description of the Prior Art

Generally, instant chow mein is made ready for eating by first pouring a large quantity of hot water on the noodles so that the noodles are warmed by the hot water and are reconstituted to their original cooked state and then by adding liquid soup or powder soup provided therewith after excess hot water has been removed. Thus, the above-described style of preparation of instant food involves the troublesome task of draining excess hot water after the noodles have been softened. Further, the food is heated only by the hot water poured onto it, and therefore it is not properly restored to its original state and the cooked food is somewhat unappetizing. In consequence, it is absolutely impossible to cook such instant noodles or spaghetti if they are thick and have a chewy consistency.

In order to cook such instant noodles or spaghetti having thick noodles, it is necessary for the noodles to be boiled in a cooking pot or other container, while being stirred. In addition, there is a risk of the water boiling over during cooking, making the preparation a very demanding task.

OBJECTS OF THE INVENTION

The primary object of the present invention is to provide a container packed with instant food which allows a solid instant food such as instant noodles to be reconstituted to its original cooked state in a short period of time in such a manner that the food has an excellent texture, and which is so improved that the contained food may be cooked easily without the need to remove excess hot water after the food has been cooked.

The above and other objects of this invention will be clear from following description.

SUMMARY OF THE INVENTION

The invention provides in one of its aspects a container packed with instant food for use in a microwave oven which comprises a container composed of a container body and a lid which is capable of tightly or substantially tightly sealing the container, as well as solid instant food accommodated in the container, wherein the food is to be reconstituted and made ready for eating on absorbing water when the container is heated in a microwave oven after water is in an amount equivalent to 100 to 155 wt. % (hereafter referred to as "%") of the water absorption capacity of the food.

The invention provides in another of its aspects a container packed with instant food for use in a microwave oven which further comprises a second container accommodated in the container body together with the solid instant food and containing said specific amount of water in the form of a seasoning soup.

DESCRIPTION OF THE PREFERRED EMBODIMENTS

Figure 1:
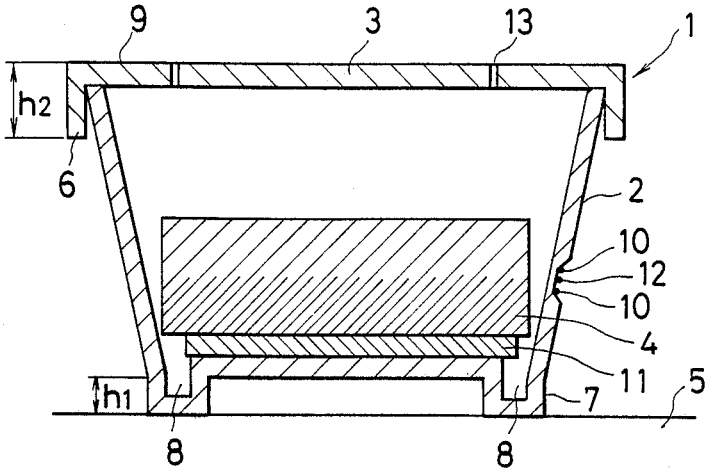
FIG. 1 is a cross-sectional view of a container packed with an instant food for use in a microwave oven according to the present invention.

A container employed in the present invention comprises a container body having an upper opening through which the contents are placed in and taken out of the container body and a lid for covering the opening in such a manner as to cause the container to be hermetically or substantially hermetically sealed. Preferably, the container body and the lid are made of a material through which microwaves may be transmitted and yet has a heat-resistance sufficient to enable the container to withstand heating in a microwave oven. Materials which transmit microwaves and are suitably employed for the container of this invention include polyethylene, polypropylene, polycarbonate, polyester, nylon, polysulfone, polyphenyleneoxide, paper and a laminate of these materials. Metallic materials which do not transmit microwaves may also be employed, and such metallic materials include aluminum, nickel, chrome, iron, zinc, tin and alloys of these materials. In this case, however, it is necessary for the container to have at least one portion through which microwaves may be transmitted.

The container is constructed in the form of a cup, tray or any other suitable shape. The container can be in the form of an inverted truncated cone, a cylinder or a square shape. It is necessary for the jointing of the container body and the lid to be so constructed that the container may be hermetically sealed (or almost hermetically sealed) so that the contents may be prevented from boiling over and escaping from the container and to ensure that the container is filled with steam when heated in a microwave oven. Suitable jointing structures include a screw cap type, and a fitting-in type in which the lid can be freely mounted and removed. In another structure which can also be adopted, a heat-shrinkable film is provided in such a manner as to surround the jointing, and this is heat-shrunk when heated in a microwave oven such as to fix the lid to the container body. Bores may be provided on the lid so as to adjust the internal pressure of the container and prevent the container from exploding as a result of any excessively high internal pressure that may be created during heating. In this case, the proportion of the surface area represented by the bores relative to the total area of the upper opening of the container body is preferably between 0.005% and 1%.

A member for raising the container is provided at the bottom thereof so that the quantity of microwaves to be irradiated to the bottom of the container may be increased and heating through convection is thereby improved. If the gap between the container and the platform of a microwave oven (which is a height of the raising member) is made to be 2 mm or more, more preferably 3 to 25 mm, by the provision of such a raising member, heating of the container by microwaves from the bottom thereof is improved, causing convection to be created and thereby effecting more efficient heating. The gap is preferably set to be within the range of 3 to 15 mm, if the platform employed in the microwave oven is of iron or is enamel coated. In the case of a platform made of glass, a gap of 3 to 9 mm should be provided.

The member for raising the container may be provided in such a manner that a depression is formed on a portion of or over the entire surface of the bottom of the container. With such a depression—in which the water and/or the seasoning soup collects during heating—provided, the boiling of the water and/or the seasoning soup in this portion will be accelerated, and the solid instant food can be more uniformly and efficiently returned to their original cooked state.

Any desired number of such depressions may be provided at any desired position on the bottom of the container, for example, around the periphery and/or at the central portion, or all over the bottom. The capacity of the depressions is preferably set at 0.7 ml or more, more preferably to be within the range between 1.5 and 17.5 ml.

The central portion of the lid may be curved downward, and means may be provided to enable the moisture which becomes attached to the lid to be led to the substantially central portion of the solid instant food.

Any solid instant food which can be reconstituted to its original cooked state on absorbing water and is thus made ready for eating can be contained in the container. Such foods include instant noodles such as chow mein, fried wheat vermicelli, spaghetti, macaroni, rice flour noodles and pasta, instant gratin, instant rice and ingredients used for seasoning these foods. The pasta in this case also includes a form thereof which is made of flour or flour and rice flour, and shaped into rice-like grains (each having a length of about 4 to 6 mm and a thickness of about 0.6 to 0.7 mm), and which is made ready for eating just like rice after it is cooked. In addition, the instant food to be contained in the container is not limited to those which can be softened by simply pouring hot water over them, but conventional types of food which may be prepared by boiling can also be utilized. Semi-dried food may also be adopted, as well as dehydrated food.

The above-described instant noodles that can be employed may either be fried or unfried. Such noodles are formed into a mass of instant noodles by, for example, a known method, before they are accommodated in the container. In order to form the noodles into a mass, the noodles, which have been processed by steaming and boiling, are put into a retainer having an appropriate size and shape and then dipped into heated oil or dried with hot-air. The mass is preferably formed such that they have a thickness of 50 mm or less, more preferably, of 35 mm or less. If the thickness exceeds 50 mm, it is preferable to arrange the noodles in a suitable way so that the upper central portion of the mass is concave, or to provide a through-hole passing vertically through the mass. With the noodles arranged in one of these ways, it is easy for the boiling water to reach all parts of the noodles during heating, thereby causing the noodles to be thoroughly and uniformly softened. Further, in case where an amount of water corresponding to 100 to 150% of the water absorption capacity of the noodles is charged in the container before the noodles are boiled, it is desirable for the level of the water which collects at the bottom of the container to be at a height which is substantially 30% or more, preferably 35% or more, relative to the upper surface of the noodles. With this arrangement, the noodles can be reconstituted to their original cooked state with better results.

In addition to the above-described effect obtained during heating, if the noodles are accommodated in the container so that the upper central part of the mass is concave, it is easier to ensure that the mass is not displaced to any great extent during transportion and that the second container keeps the mass in place or substantially in place at this time, thereby preventing the noodles from being damaged. Another advantage of this arrangement is that the solid ingredients contained in the second container can be accommodated in this depression and that the mass of noodles and the second container can be packed in the container in a compact way.

It is preferable for the noodles which can be employed in this invention, whatever the type, to be packed with a void proportion set to be between 32 and 85%, more preferably between 45 and 80%. With a void allowance falling within the above ranges, the boiled water can be prevented from causing the noodles to float up during heating, and the boiling water can be allowed to uniformly reach the upper portion of the mass of noodles, thereby enabling the noodles to be softened with excellent results. The mass of noodles in the container can be of any shape. However, it is preferable for the noodles to be packed in such a way that there is no square portion in the horizontal cross-section of the mass of noodles, i.e., that they have a roughly circular or elliptical shape, thus enabling uniform softening.

The instant noodles employed in this invention are preferably arranged into a mass in which the noodles of the upper portion are loosely arranged and those of the lower portion densely packed together, and the noodles are packed in the container in this state, i.e., with the densely packed portion positioned underneath. In consequence, it is possible for the noodles of the lower portion to adequately make contact with the intensely boiling water during heating, and thus to be well softened. In addition, the presence of the densely packed lower part of the noodles causes the level of the water in the container to be raised and allows the boiling water to more smoothly reach the upper portion of the noodles through the narrow gaps between the densely packed noodles of the lower portion, thereby allowing the upper portion to be well softened as well. Therefore, even thick instant noodles can be uniformly and satisfactorily softened in a short period of time.

Preferably, the upper and lower portions of the noodles are formed such that the void proportion of the lower half of the noodle mass (the portion represented by substantially 50% of the overall height of the mass) is between 52% and 97%, more preferably 75% and 93% of that of the upper half (the remaining portion occupying substantially the upper 50% of the overall mass of the noodles). In consequence, the noodles of the densely gathered lower half can be efficiently softened, while the noodles of the upper half can be at the same time softened efficiently, thus allowing the entire mass of noodles to be reconstituted to their edible state more uniformly.

The void allowance of the present invention is obtained by the following calculation.

Void proportion =

-continued $$\frac{\text{(Apparent Volume of the Mass of Noodles} - \text{Solid Volume of the Mass of Noodles)}}{\text{Apparent Volume of the Mass of Noodles}} \times 100$$

In order to arrange the mass of noodles in the above-described way, the noodles are accommodated in a retainer having an appropriate shape, after they have been processed by steaming and boiling and are then separated into portions, if necessary, and that retainer is then dipped into heated oil, thereby forming in the retainer a densely packed part and a loosely arranged part by virtue of the lifting force caused by buoyancy of the noodles.

The seasoning ingredients that can be employed in this invention include vegetables such as cabbage, onion, carrots and greenpeas; meat such as beef, pork and chicken; seafood such as shrimps, squid, boiled fish paste, tubular fish paste cake and clams; and processed seafood goods. These foods are employed in a dehydrated or semi-dried form, or raw, or as a mixture of these forms.

The container packed with the above-described solid instant food according to the present invention is heated in a microwave oven after water is added thereto in an amount equivalent to between 100 and 155% of the water absorption capacity of the food. Hot water may be employed in place of cold water, or seasoning soup may alternatively be used. The amount of water added is preferably between 100 and 155%, more preferably between 100 and 132%, of the water absorption capacity of the instant food. The amount of water to be added includes that of the seasoning soup.

The water absorption capacity of the instant food is derived by subtracting the water content possessed by the instant food before it is heated from that of the food which has been satisfactorily softened. If the amount of water added exceeds 155% of the water absorption capacity of the food, there may be a large amount of hot water left in the container after the food has been heated for sufficient time to enable the food to be satisfactorily softened, and that hot water must be drained away. The cooked instant food will become too sticky if there is too much hot water. On the other hand, if the amount of water added is less than 100% of the water absorption capacity of the food, it is impossible for the food to be reconstituted to its cooked state satisfactorily, owing to the insufficient absolute quantity of water. The water content of instant food when it has been satisfactorily softened is, for example, between 57 and 62% for instant chow mein and instant fried wheat vermicelli, between 60 and 65% for instant spaghetti and instant macaroni, and between 62 and 67% for instant rice.

Means for showing the level of water to be added may be provided inside the container body. Alternatively, at least one portion of the container body may be made transparent, and a mark showing the level of water to be added may be provided on the inside or outside of the container body. In such a case, three marks may be provided to show the water levels required for reconstituting the food to an al dente, ordinary, or very soft state, respectively. The instant food and the container are preferably designed so that the level of water which collects at the bottom of the container before the food is heated comes to about 30% or more of the height of the top surface of the food. With this arrangement, the food can be reconstituted to its original cooked state with much better results. If it is designed to heat the instant noodles and the seasoning ingredients together, it is preferable that the seasoning ingredients are placed in the container in such a manner that they are under the instant noodles. This can effectively prevent scorching of the seasoning ingredients during heating.

In the present invention, it is preferable that the water which is to be added is provided beforehand in a container in the form of a seasoning soup, and that that container is preferably accommodated within the container body, together with the food, as a second container.

This second container is preferably made of a synthetic resin such as polyethylene, polypropylene, or a laminate of any of these resins and a metal layer such as aluminum foil. If the second container is made of a flexible material (such as a film) and formed into a bag-like shape (such as a retort pouch), it is possible for the second container to serve as a cushioner for the food when it is held in place (or substantially held in place) within the container, thus preventing the food being damaged.

The second container may be constructed in the form of a cup, tray, bag or any other suitable shape. The second container can have an inverted, truncated conical, cylindrical or square shape.

It is desirable for the second container to be tightly sealed after the seasoning soup is placed in it, so that the soup is not spilled. The second container may, for example, be formed from a container of a predetermined shape and a lid which is able to tightly seal the container. Alternatively, the second container may be formed from laminated films or sheets by sealing their peripheries.

It is preferable that the second container be formed to have a shape and size which enables it to hold the instant food in place, or substantially hold the food in place, in the container when it is accommodated in the container together with the food, so as to prevent the food being damaged. If the second container is flexible, i.e., is supplied as a retort pouch, and if the second container contains air together with the seasoning soup, in an amount equal to between 1 and 99%, more preferably between 5 and 90%, of the capacity of the second container remaining after the volume of the seasoning soup to be contained is subtracted from the total capacity of the second container, it is possible for the second container to act as a more effective impact cushioner, and damage to the food can be efficiently prevented during storage and transportion.

The second container according to the present invention is adapted to accommodate seasoning soup which contains water in an amount equal to between 100 and 155%, preferably between 100 and 132% of the water absorption capacity of the solid instant food.

If it is desired to have a certain amount of seasoning soup (sauce) left after the food has been prepared, for example, for spaghetti or noodles prepared in a sticky sauce, the amount of water contained in the seasoning liquid may be increased.

The viscosity of the seasoning liquid employed in the present invention is set to be at 1750 poise or less, preferably at 800 poise or less, and more preferably 450 poise or less, at a temperature of 60° C. If the viscosity of the seasoning liquid is too high when the food is heated in a microwave oven after seasoning liquid is poured over the food, it is difficult to reconstitute the food to its cooked state satisfactorily, and the heated food will be sticky.

Viscosity means that of the seasoning liquid at a temperature of 60° C.

In the case of food prepared in a sticky sauce, it is desirable for the seasoning liquid to have a certain degree of viscosity even after the food has been cooked. In such a case, the viscosity of the seasoning soup may be set at 320 poise or more, preferably 580 poise or more.

An edible foaming substance may be added to the instand food and/or the seasoning soup in order to enable intense boiling during heating in a microwave oven. Such a foaming substance includes an emulsifier having a high degree of HLB such as sucrose fatty ester, sorbitan fatty ester and foaming vegetable protein disassimilation products. Among these, an emulsifier having an HLB value of 8 or above is preferable. Sucrose fatty ester is preferable when it is particu1ar1y desired to enable intense boiling. It is preferable for the foaming substance to be added to the instant food and/or the seasoning soup in an amount equivalent to between 0.01 and 5% of the weight of the softened food. The amount of the foaming substance may be freely determined within the above-described range, the choice depending on the salt content of the instant food (because it is generally necessary to increase the amount of foaming substance added as the salt content of the instant food increases). Thus, with the foaming substance added, it is possible to obtain sufficient boiling even when the contents are heated by a microwave oven of a type with low heating capacity.

The seasoning ingredients may be added in advance in the seasoning soup employed in the present invention.

The second container is taken out of the container according to the present invention, and the seasoning soup is poured over the solid instant food, or cold or hot water is added in an amount equal to between 100 and 155% of the water absorption capacity of the solid instand food. When the container in this state is heated by a microwave oven, since the container has been tightly closed or substantially tightly closed, the interior of the container can be heated to the temperature of the intense boiling water and the surface of the boiling water is allowed to reach as far as the upper portion of the instant food in the container. The interior of the container can also be filled with steam, thereby enabling the instant food to be thoroughly and uniformly reconstituted in a short period of time. In other words, heating efficiency can be increased by the steam filling the container. In consequence, even when absorption of water by the instant food proceeds and the water level becomes low in the latter half stage of heating, it is possible for all the food to be uniformly softened, while the upper part of the food is not dried.

With the amount of water and/or the water content of the seasoning soup set at the above-described amount, it is also possible for the water to be substantially completely absorbed by the food during heating. Excess water is evaporated, and the need to drain water after the heating is completed is thereby eliminated. In addition to this fact, since the instant food is heated at a high temperature according to the present invention just as if they were being boiled, it is possible for the food to maintain an excellent texture and appearanced when prepared, thereby allowing the food to retain a chewy consistency and crystalline color. It is also possible to reconstitute thick noodles with good results.

Although the container packed with instant food according to the present invention is basically arranged in the above-described manner, it will be apparent that other modifications of the invention are possible which fall within the scope of the invention.

Embodiments of the present invention will be described hereinunder with reference to the accompanying drawings, in which FIG. 1 is a schematic cross-sectional view of a container 1 containing the instant noodles according to the present invention. Referring first to FIG. 1, the container packed with the instant noodles comprises a container 1 having a container body 2 and a lid 3 for covering the upper opening of the container body 2, and dehydrated instant noodles 4 accommodated in the container 1.

The container body 2 and the lid 3 are both formed of a laminate with a thickness of 0.5 mm which is formed of polypropylene, disposed on the inner side of the container, and paper, disposed on the outer side thereof. The container body 2 is a substantially inverted, truncated cone in shape, its upper opening having a diameter of 120 mm, its inner bottom surface a diameter of 105 mm, and its height being 64 mm. Leg portions 7 which are effective is raising the contents above the surface of a platform 5 of the microwave oven (hl=9 mm) are integrally formed on the bottom surface of the container body 2. The leg portions 7 are provided in such a manner that four depressions 8 are formed at the periphery of the inner bottom surface of the container body 2 (each depression 8 having a capacity of 0.85 ml).

The lid 3 includes a disc-shaped plate 9 having outer and inner diameters of 122 mm and 121 mm, and a portion 6 extending from the upper periphery of the disc-like plate 9 in such a manner that it overhangs the side of the container body 2 (the height of this portion 6, h2 is 12 mm). Eight circular bores 13, each having a diameter of 3.2 mm, are provided on the lid 3 in a radial pattern with the center of the lid 3 as its center (the bore proportion in this case is 0.57% of the area of the upper opening of the container body 2).

Since the upper periphery of the container body 2 is substantially equal to the inner diameter of the disc-like plate 9 of the lid 3, the lid 3 is tightly fitted, as shown in FIG. 1, so that the interior of the container is hermetically sealed. A part of the side wall of the container body 2 is formed by a layer of propylene only, and marks 10, 10 are provided on this part such as to show the correct levels of water to be added.

The dehydrated instant noodles 4 is constituted by a fried mass of noodles formed with 70 parts of wheat flour, 30 parts of potato starch, 32 parts of water, 0.3 part of brine and 1 part of salt, and these ingredients are made into noodles by a conventional procedure. After being processed by steaming and boiling, the noodles are accommodated in a retainer which is dipped into heated oil, whereby the noodles of a part of the mass become loosely arranged, while those of the other part are densely packed within the retainer by virtue of the lifting force caused by the buoyancy of the noodles. The thus-manufactured mass of noodles 4 is cylindrical in shape, and has a diameter of about 100 mm and a height of about 30 mm. The apparent and solid volumes of this mass are 235.5 ml and 93.5 ml, respectively, while the void proportion is about 60%. The solid volume and void proportion of the upper half of the mass are respectively 44 ml and about 63%, while those of the lower half are 49.5 ml and about 58% (the void proportion of the lower half of the mass is equal to about 92% of that of the upper half).

4 g of dried seasoning ingredients 11, i.e., dried cabbage, is placed under the dried instant noodles 4.

The thus-arranged container 1 containing the instant noodles 4 had water of normal temperature poured into its until the water level reached a line 12. The amount of water added equalled 130 ml (which is also equal to about 130 wt % of the water absorption capacity of the dried instant noodles 4 and dried seasoning ingredients 11), and the level of the poured water reached a height of about 18 mm above the inner bottom of the container 1. Next, the container 1 was tightly sealed by being covered with the lid 3, and it was then placed in the microwave oven and heated for 5 minutes (with intense heating at 500 W). After the heating was completed, the container 1 was taken out of the microwave oven. When the lid 3 was removed, it was found that all of the water added had been absorbed by the noodles and seasoning ingredients, and that the noodles had a crystalline color and an appetizing appearance. 15 g of liquid sauce was added to the noodles and stirred, and 0.5 g of fish flour (green laver) was sprinkled over the noodles to make the noodles (chow mein) ready for eating. When eaten, it was found that the noodles were thoroughly and uniformly reconstituted to their original cooked state with an excellent texture.

Figure 2:
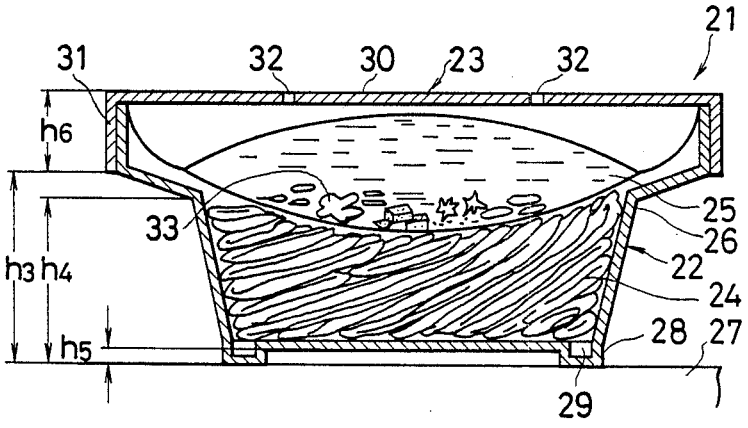
FIG. 2 is a schematic cross-sectional view of a modified form of a container containing instant food for use in a microwave oven according to the present invention.

Referring to FIG. 2, which is a schematic cross-sectional view of another embodiment of a container 21 packed with instant noodles 24 according to the present invention. The container 21 comprises a container body 22, a lid 23 for covering the upper opening of the container body 22, dehydrated instant noodles 24 and a second container 25, the noodles 24 and the second container 25 being accommodated in the container 21.

The container body 22 and a lid 23 are formed by the laminate with a thickness of 0.5 mm which is formed of polypropylene, disposed on the inside of the container, and paper, disposed on the outside thereof. The upper opening of the container body 22 has a dimension of 130×165 mm; an inner shoulder 26, 126×134 mm; the inner bottom, 115×120 mm; the height being 46 mm; h3, 35 mm; and h4, 30 mm. The upper opening of the container body 22 is rectangular in shape, and has four corners which are formed into circular arcs described with a radius of 35 mm. A member 28 which is effective in raising the contents above the surface of a platform 27 of the microwave oven (h5=9 mm) is integrally formed to the container body 22. The member 28 is formed in such a manner as to form a depression 29 (having a capacity of 4.7 ml) on the inside of the container body 22. The lid 23 includes a flat plate 30 having outer and inner diameters of 132×167 mm and 131×166 mm, and a portion 31 extending from the upper periphery of the flat plate 30 and overhanging the side of the container body 22 (the height of the portion 31, h6 is 12 mm). Eight circular bores 32 having a diameter of 3.2 mm are provided on the lid 23 in a radial pattern with the center of the lid 23 as its center (the bore proportion is 0.3% of the area of the upper opening of the container body 22).

Because the diameter of the upper periphery of the container body 22 is substantially equal to the inner diameter of the flat plate 30 of the lid 23, the lid 23 can be tightly fitted to the container body 22, as shown in FIG. 2, so that the interior of the container 21 is tightly sealed.

The dehydrated instant noodles 24 is constituted by a fried mass of noodles formed with 70 parts of wheat flour, 30 parts of potato starch, 32 parts of water, 0.3 part of brine and 1 part of salt, and these ingredients are formed into a mass of noodles by a conventional procedure. The mass is about 115×120 mm in cross-section, and has four corners which are formed into circular arcs described in with a radius of 35 mm. These mass of noodles 24 has a height of about 26 mm, and is substantially formed in a square pillar shape. The apparent and solid volumes and void proportion of the mass are 331 ml, 145 ml and about 56%, respectively.

The mass of instant noodles 24 has a shape in which the upper central portion thereof is concave. The second container 25, which is in the form of a retort pouch, is formed by a laminate having a thickness of 0.09 mm and which is formed of polyethylene disposed on the inner surface, polypropylene disposed on the outer surface and aluminum foil interposed between these two. Such a laminate is laid on top of the other, and four sides of these two laminates are heat sealed such as to form a retort pouch. The second container 25 has a dimension of 130×165 mm and a capacity of about 200 ml. The second container 25 accommodates 180 g of ingredients 3 and the chow mein sauce having a viscosity of 2 centipoise which contains water in an amount equal to 135 wt. % of the water absorption capacity of the instant noodles 24.

When the instant noodles 24 and the second container 5 are contained in the container 21, they are piled on top of the other so that the instant noodles 24 are substantially held in place by the second container 25.

The lid 23 of the thus-arranged container 21 containing the instant food was removed from the container body 22, and the sauce contained in the second container 25 was poured over the instant noodles 24 in the container body 22. The level of the sauce in this case reached a height of 14 mm above the inner bottom of the container 21. Next, the container 21 was tightly sealed by being covered with the lid 23, and was then placed in the microwave oven and heated for 5 minutes (with intense heating at 500 W). When the container 21 was taken out of the oven, and the lid 23 was removed after the completion of heating, it was found that the water content of the sauce was all absorbed in the noodles 24 and that the noodles 24 had an excellent texture and appearance. Further, because the instant noodles 24 were substantially held in place within the container 21 by the second container 25 (in the form of retort pouch), displacement of the noodles 24 during transportion was reduced. Even when the noodles 24 were displaced, shock was absorbed by the second container 25, and the damage to the noodles 24 was reduced.

As will be understood from the foregoing description, according to the present invention, it is possible to make instant food ready for eating easily and quickly simply by heating the food in a microwave oven without the need to drain excess water after the food is prepared. Since cold water can be employed, it is not necessary to prepare hot water. This enables easy handling of the instant food. In addition to this fact, it is possible for the food to be reconstituted to its original cooked state with excellent quality results. Therefore, a wide variety of food can be employed.

If water which is suitable for use in softening the instant food is supplied in the form of a seasoning soup contained in the second container, it is easier to prepare the instant food in the home.

Accordingly, the container packed with the instant food according to the present invention may be shrink packaged and then put on the market on a wide scale.

What is claimed is:

1. A container packed with instant food which is for use in a microwave oven, said container comprising:

(a) a container body having an opening at its upper portion and a lid which is capable of tightly or substantially tightly sealing said container body by covering the opening, said lid having a plurality of holes therethrough such that the total surface area represented by said plurality of holes relative to the total area of the opening is between 0.005% and 1%, said container body and said lid being made of materials through which microwaves are transmitted;

(b) dehydrated instant food comprising instant noodles containing an edible foaming substance and seasoning ingredients accommodated in said container body;

(c) a second container in the form of a retort pouch accommodated in said container body, said second container hermetically containing a seasoning soup containing an edible foaming substance and having a viscosity of 1750 poise or less at a temperature of 60° C., said seasoning soup having a water content of an amount equivalent to between 100 to 155 wt. % of the water absorption capacity of said dehydrated instant food; and (d) a member on the bottom of said container body for raising said container body above a surface on which it is placed, said member containing a large number of depressions, wherein:

(e) said dehydrated instant food is held in place or substantially held in place in said container body by said second container;

(f) said dehydrated instant food is formed in a shape in which the upper central portion thereof is concave;

(g) the void proportion of said instant noodles is between 32% and 85%;

(h) the mass of said instant noodles has a height of 50 mm or less;

(i) said instant noodles are formed into a mass in which the noodles of the upper portion are loosely arranged and those of the lower portion are densely packed together; and (j) the lower half of said mass of instant noodles has a void proportion which is between 52% and 97% of that of the upper half.

* * * * *